US010126065B2

(12) United States Patent
Pautler et al.

(10) Patent No.: US 10,126,065 B2
(45) Date of Patent: Nov. 13, 2018

(54) HEAT EXCHANGER ASSEMBLY HAVING A REFRIGERANT DISTRIBUTION CONTROL USING SELECTIVE TUBE PORT CLOSURES

(71) Applicant: MAHLE International GmbH, Stuttgart (DE)

(72) Inventors: Donald R. Pautler, Lockport, NY (US); Douglas C. Wintersteen, Burt, NY (US); Neil A. Walkowski, Orchard Park, NY (US); Longhu Li, Williamsville, NY (US); Wayne O. Forrest, Gasport, NY (US); Shrikant M. Joshi, Williamsville, NY (US)

(73) Assignee: MAHLE International GmbH, Stuttgart (DE)

( * ) Notice: Subject to any disclaimer, the term of this patent is extended or adjusted under 35 U.S.C. 154(b) by 308 days.

(21) Appl. No.: 14/741,725

(22) Filed: Jun. 17, 2015

(65) Prior Publication Data

US 2016/0370119 A1 Dec. 22, 2016

(51) Int. Cl.

| | |
|---|---|
| ***F28D 1/053*** | (2006.01) |
| ***F28F 9/02*** | (2006.01) |
| *F28D 21/00* | (2006.01) |

(52) U.S. Cl.

CPC ..... *F28D 1/05375* (2013.01); *F28D 1/05383* (2013.01); *F28F 9/0282* (2013.01); *F28D 2021/0068* (2013.01)

(58) Field of Classification Search

CPC ..... F28D 1/05375; F28D 1/05383; F28D 2021/0068; F28D 1/05333; F28D 1/05341;

(Continued)

(56) References Cited

U.S. PATENT DOCUMENTS 1,684,083 A 6/1927 Bloom
2,310,234 A * 2/1943 Haug ..... F28B 1/02 165/110

(Continued)

FOREIGN PATENT DOCUMENTS

JP 58200997 A * 11/1983 ..... F28D 1/0478
JP 02217764 A 8/1990

(Continued)

OTHER PUBLICATIONS

JP58200997A—Machine English Translation.pdf.*
Experimental and numerical study on microchannel and round-tube condensers.*

*Primary Examiner* — Orlando E Aviles Bosques
*Assistant Examiner* — Jose O Class-Quinones
(74) *Attorney, Agent, or Firm* — Brinks Gilson & Lione

(57) ABSTRACT

A heat exchanger assembly having a first manifold, a second manifold spaced from the first manifold, and a plurality of refrigerant tubes in hydraulic communication with the first manifold and the second manifold. The second manifold includes a first end, a second end opposite from the first end, and a refrigerant inlet adjacent the first end. The plurality of refrigerant tubes includes tube ports. A portion of the tube ports are selectively obstructed such that a refrigerant entering into the second manifold through the refrigerant inlet flows substantially uniformly across the plurality of refrigerant tubes from the second manifold to the first manifold. At least one of the obstructed tube ports includes an inserted sliver of braze amendable material, pinched closed, or formed by inserting a pin of reduced diameter into the selected ports and then squeezing the port from the outside to size it and then removing the pin.

13 Claims, 4 Drawing Sheets

(58) Field of Classification Search
CPC . F28D 1/05358; F28F 9/0282; F28F 2220/00; F28F 2260/02; F28F 1/006; F28F 1/022; F28F 1/025; F28F 1/08; F28F 1/05391; F28F 13/08; F28F 9/22; F28F 9/0212; F28F 2009/226; F28F 2009/222; F28F 9/24; F16L 55/1116
See application file for complete search history.

(56) References Cited

U.S. PATENT DOCUMENTS

| | | | | |
|---|---|---|---|---|
| 3,976,128 | A | 8/1976 | Patel et al. | |
| 5,651,268 | A | 7/1997 | Aikawa et al. | |
| 5,806,586 | A | 9/1998 | Osthues et al. | |
| 5,971,065 | A | 10/1999 | Bertilson et al. | |
| 6,161,616 | A | 12/2000 | Haussmann | |
| 6,564,863 | B1 * | 5/2003 | Martins | F28D 1/05383 165/153 |
| 7,143,605 | B2 | 12/2006 | Rohrer et al. | |
| 8,234,881 | B2 * | 8/2012 | Yanik | F25B 39/00 62/515 |
| 2002/0066554 | A1 * | 6/2002 | Oh | F28D 1/0535 165/179 |
| 2003/0116310 | A1 | 6/2003 | Wittmann et al. | |
| 2004/0026072 | A1 | 2/2004 | Yi et al. | |
| 2008/0099191 | A1 * | 5/2008 | Taras | F25B 39/028 165/174 |
| 2009/0073483 | A1 | 3/2009 | Oomori | |
| 2009/0173482 | A1 | 7/2009 | Beamer et al. | |
| 2009/0229805 | A1 | 9/2009 | Beamer et al. | |
| 2011/0030935 | A1 * | 2/2011 | Riondet | F28D 1/0443 165/173 |

FOREIGN PATENT DOCUMENTS

| | | | |
|---|---|---|---|
| JP | 04309766 | A | 11/1992 |
| JP | 2002062082 | A | 2/2002 |
| WO | 94/14021 | | 6/1994 |

* cited by examiner

HEAT EXCHANGER ASSEMBLY HAVING A REFRIGERANT DISTRIBUTION CONTROL USING SELECTIVE TUBE PORT CLOSURES

TECHNICAL FIELD OF INVENTION

The present disclosure relates to a heat exchanger; more particularly, to a heat exchanger having a refrigerant distribution control device.

BACKGROUND OF INVENTION

Residential and commercial heat pump systems are known to employ modified automotive heat exchangers, which are desirable for its proven high heat transfer efficiency, durability, and relatively ease of manufacturability, as heat pump heat exchangers. A conventional automotive heat exchanger typically includes an inlet manifold, an outlet manifold, and a plurality of refrigerant tubes hydraulically connecting the manifolds for refrigerant flow therebetween. The refrigerant tubes utilized are typically flat tubes having a plurality of micro-channels, or ports, for refrigerant flow and are manufactured from extruded aluminum alloy or folded from a sheet of aluminum alloy. Corrugated fins interconnect adjacent refrigerant tubes to increase the available heat transfer area, as well as to increase the structural integrity of the heat exchanger. The core of the heat exchanger is defined by the refrigerant tubes and interconnecting corrugated fins.

Heat pump heat exchangers, also known as heat pump coils, are capable of operating as an evaporator and as a condenser. A heat pump system typically includes two heat pump heat exchangers, one located outdoor and the other indoor. When the heat pump system is in cooling mode, the indoor heat pump heat exchanger operates in evaporator mode and the outdoor heat pump heat exchanger operates in condenser mode. When the heat pump system is in heating mode, the indoor heat pump heat exchanger operates in condenser mode and the outdoor heat pump coil operates in evaporator mode.

To meet the demands of residential and commercial applications, the size of the core of the heat pump heat exchanger needed to be increased accordingly, which in turn dramatically increased the lengths of the inlet and outlet manifolds. For a heat pump heat exchanger operating in evaporator mode, the increased length of the manifolds tends to result in refrigerant mal-distribution through the row of refrigerant tubes. The effects of momentum and gravity, due to the large mass differences between the liquid and gas phases, can result in separation of the phases in the inlet manifold and cause poor refrigerant distribution through the row of refrigerant tubes. Poor refrigerant distribution degrades evaporator performance and can result in uneven temperature distribution over the core.

To assist in providing uniform refrigerant distribution through the refrigerant tubes, it is known to dispose an inlet distributor tube within the inlet manifold for distributing the two-phase refrigerant throughout the length of the inlet manifold. The distributor tube extends along substantially the length of the inlet manifold and includes a plurality of substantially evenly spaced orifices for evening distributing a liquid refrigerant to the inlets of the refrigerant tubes. Similarly, an outlet collector tube is disposed within the outlet manifold for evenly collecting the vapor refrigerant exiting the outlet ends of the refrigerant tubes.

The outlet collector and distributor tubes are costly in terms of materials, manufacturing, and shipping of the tubes, as well as the time and labor required for the assembling of the tubes in the outlet and inlet manifolds, respectively. Accordingly, there remains a need for a heat pump heat exchanger having a refrigerant distribution control that eliminates the need for at least one of the outlet collector and distributor tubes.

SUMMARY OF THE INVENTION

The invention relates to a heat exchanger assembly having a first manifold, a second manifold spaced from the first manifold, and a plurality of refrigerant tubes in hydraulic communication with the first manifold and the second manifold. The second manifold includes a first end, a second end opposite from the first end, and a refrigerant inlet adjacent the first end. The plurality of refrigerant tubes includes micro-channels and tube ports configured for accepting refrigerant flow into and out of the micro-channels. A portion of the tube ports are selectively obstructed or closed such that a refrigerant entering into the second manifold, inlet manifold, through the refrigerant inlet would flow substantially uniformly across the bank of refrigerant tubes from the second manifold to the first manifold; thereby providing uniform heat transfer across the core of the heat exchanger assembly. At least one of the obstructed tube ports may include an inserted sliver of braze amendable material. As an alternative, the at least one of the obstructed tube ports may be pinched closed. As another alternative, at least one of the obstructed tube ports may be formed by inserting a pin of reduced diameter into the selected port and then squeezing the port from the outside to size it and then removing the pin.

An advantage of selectively closing tube ports to achieve uniform distribution of refrigerant through the core is the potential elimination for the need of one or more refrigerant distribution tubes. This would reduce the cost of the heat exchanger due to the reduction in costs of materials required, reduction in labor for assembly, and shipping cost due to overall weight reduction. Another advantage of selectively closing the tube ports would allow for greater flexibility in the design of the heat exchanger assembly since a different sized collector is not required for different heat exchanger configurations.

In the drawings as hereinafter described, a preferred embodiment is depicted; however, various other modifications and alternative designs and construction can be made thereto without departing from the spirit and scope of the invention.

BRIEF DESCRIPTION OF DRAWINGS

This invention will be further described with reference to the accompanying drawings in which.

DETAILED DESCRIPTION OF INVENTION

Figure 1:
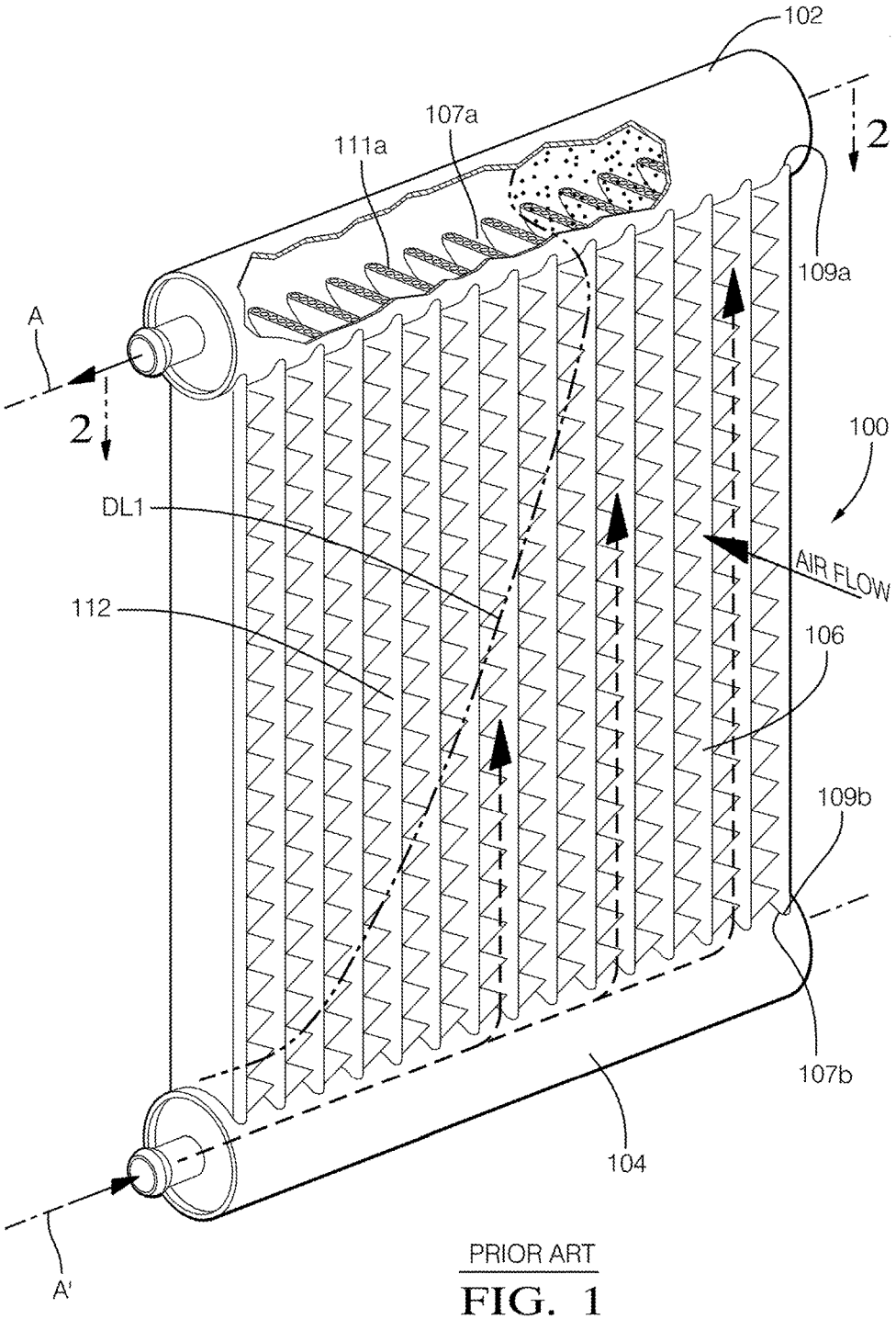
PRIOR ART FIG. 1
FIG. 1 shows a perspective partial cutaway view of a prior art heat exchanger assembly.

Shown in FIG. 1 is a perspective view of a prior art heat exchanger assembly 100 capable of operating in evaporator mode and condenser mode, depending on the mode of the heat pump system. The heat exchanger assembly 100 includes a first manifold 102, a second manifold 104, and plurality of flat micro-channel refrigerant tubes 106 hydraulically connecting the manifolds 102, 104. The refrigerant tubes 106 include opposite ends 107*a*, 107*b* that are inserted through corresponding tube slots 109*a*, 109*b* positioned along the length of the manifolds 102, 104. A refrigerant enters and exits the micro-channels 110 by way of tube ports 111*a*, 111*b*, or tube openings, located on the opposite ends 107*a*, 107*b* of the refrigerant tubes 106. A plurality of corrugated fins 108 is disposed between and in thermal contact with adjacent refrigerant tubes 106 to facilitate heat transfer between the refrigerant flowing within the refrigerant tubes 106 and a stream of ambient air flowing passing by the exterior surfaces of the refrigerant tubes 106 and fins 108. The refrigerant tubes 106 together with the fins 108 define the core 112 of the heat exchanger assembly 100.

The first manifold 102 is shown above the second manifold 104 with respect to the direction of gravity; therefore, the first manifold 102 is known as the upper manifold 102 and the second manifold 104 is known as the lower manifold 104. Either manifolds 102, 104 may function as an inlet or outlet manifold 102, depending on the mode of the heat exchanger. In evaporator mode, a two-phase gas/liquid refrigerant flows from the lower manifold 104 through the row of refrigerant tubes 116 to the upper manifold 102. As the two-phase refrigerant absorbs heat from the stream of ambient air, the refrigerant expands into a low pressure vapor refrigerant. In condenser mode, a high pressure vapor refrigerant flows from the upper manifold 102 to the lower manifold 104 and condenses to a high pressure liquid refrigerant as heat is dissipated to the stream of ambient air. In other words, the upper manifold 102 functions as an outlet manifold 102 when the heat exchanger assembly 100 is in evaporator mode and as an inlet manifold 102 when the heat exchanger assembly 100 is in condenser mode.

Due to higher heating and cooling load demands, residential and commercial heat exchangers require manifolds 102, 104 to be typically 3 to 8 times the length of a conventional automotive manifold. This dramatically increases the lengths of the upper and lower manifolds 102, 104 along manifold axis A and A', respectively. Distribution tubes (not shown) are known to be used in either or both of the manifolds 102, 104 in order to provide even refrigerant distribution across the row of refrigerant tubes 106 to provide uniform heat transfer across the core 112. A conventional distribution tube typically includes a cylindrical hollow tube having a plurality of orifices spaced along its length and extends substantially the full length of the manifolds 102, 104. Distribution tubes used in the inlet manifold 102 are known as inlet distributors and distribution tubes used in the outlet manifolds 102 are known as outlet collectors.

Figure 2:
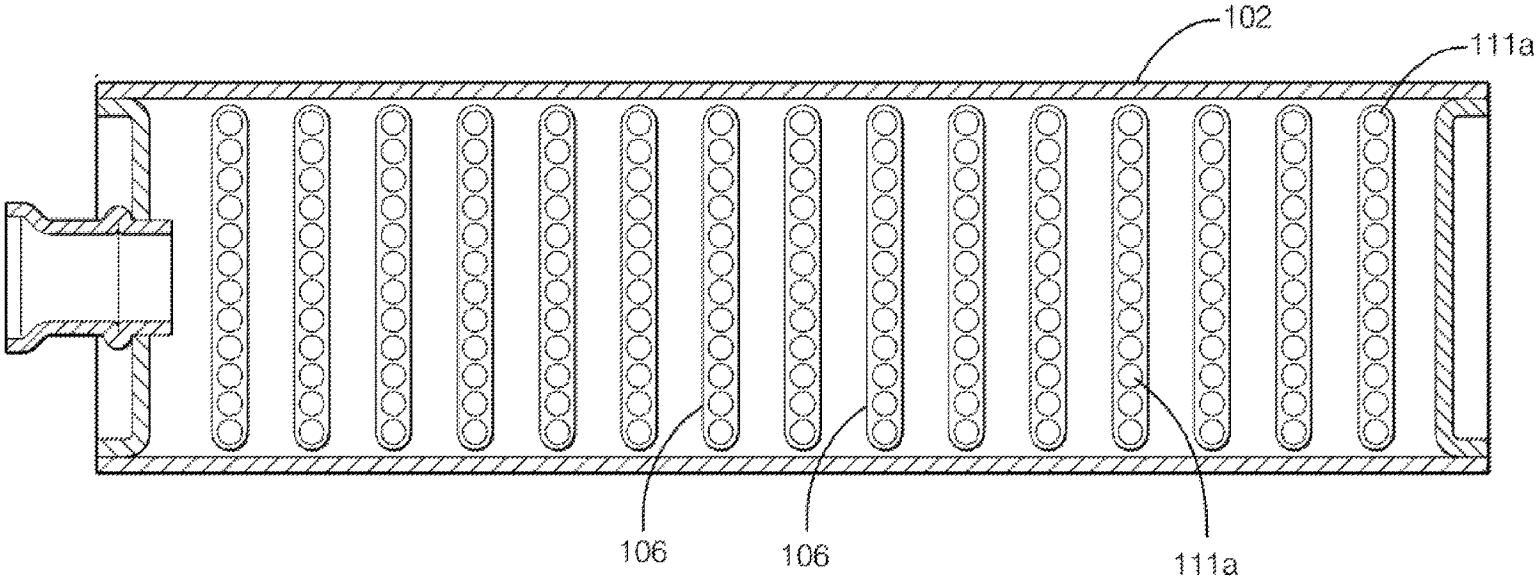
PRIOR ART FIG. 2
FIG. 2 shows an end view of the flat micro-channel tubes of the prior art heat exchanger assembly of FIG. 1, through section line 2-2, having non-obstructed tube ports.

Presented in FIG. 2 is the prior art heat exchanger assembly 100 of FIG. 1 showing a section view of the upper manifold 102 through section line 2-2. Extending into the upper manifold 102 is a plurality of parallel substantially flat micro-channel refrigerant tubes 106. Each of the refrigerant tubes 106 includes a plurality of tube ports 111*a* through which a refrigerant enters or exits the upper manifold 102 depending on the operating mode of the heat exchanger assembly 100. Referring back to FIG. 1, in evaporator mode, as the two phase refrigerant enters the lower inlet manifold 102, second manifold 104, from the left side through the refrigerant inlet 114, the momentum of the flowing refrigerant carries the two phase refrigerant to the far right portion of the second manifold 104 causing a greater mass portion of refrigerant flow to enter the row of refrigerant tubes 106 nearest the right portion of the heat exchanger assembly 100, thereby starving the left portion of the heat exchanger assembly 100 of refrigerant. This causes uneven heat transfer across the core 112 of the heat exchanger assembly 100 due to the refrigerant mal-distribution, as represented by the dashed line (DL1), resulting in non-uniform heat transfer through the core 112.

Figure 3:
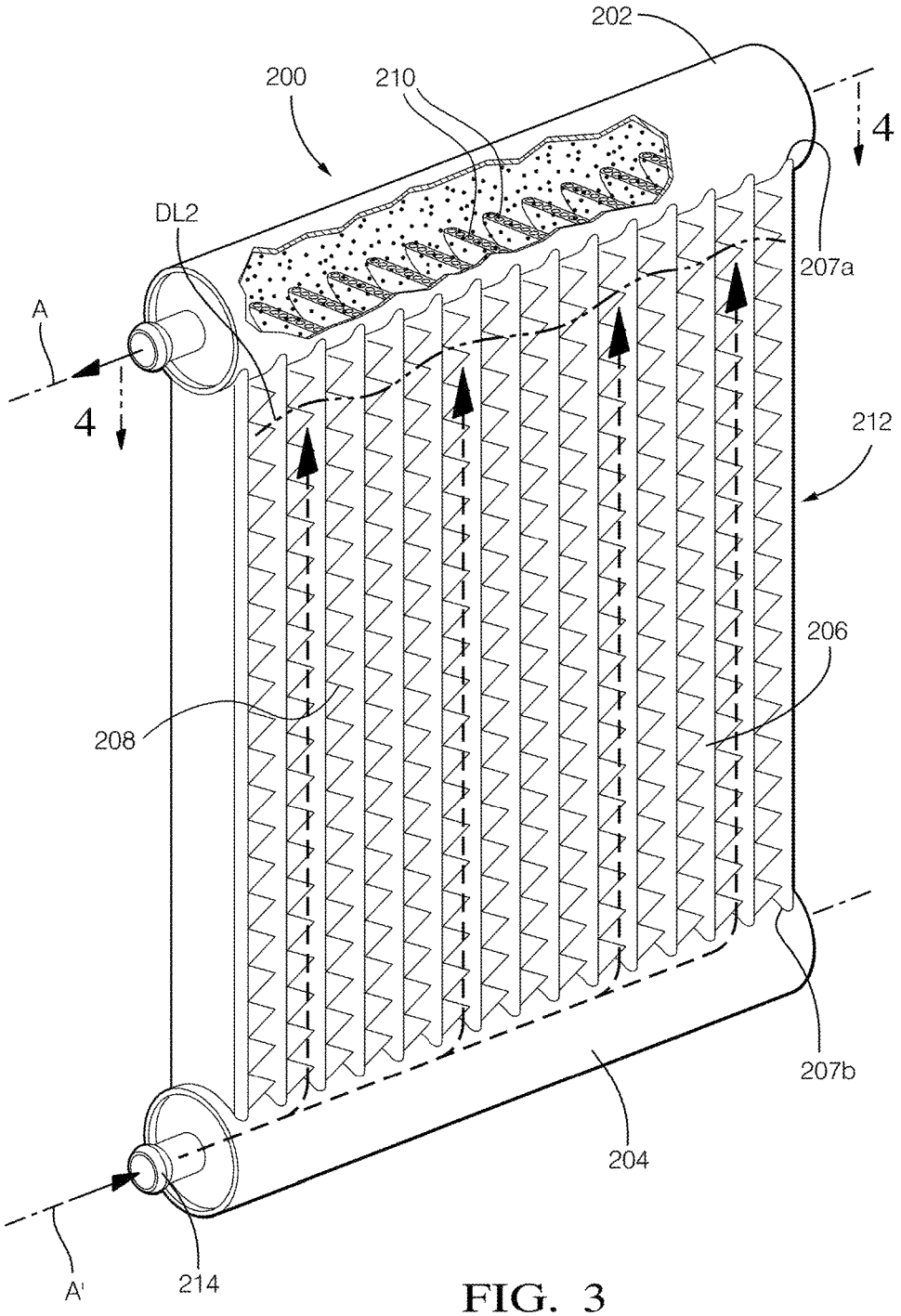
FIG. 3 shows a perspective partial cutaway view of a heat exchanger assembly of the current invention.
Figure 4:
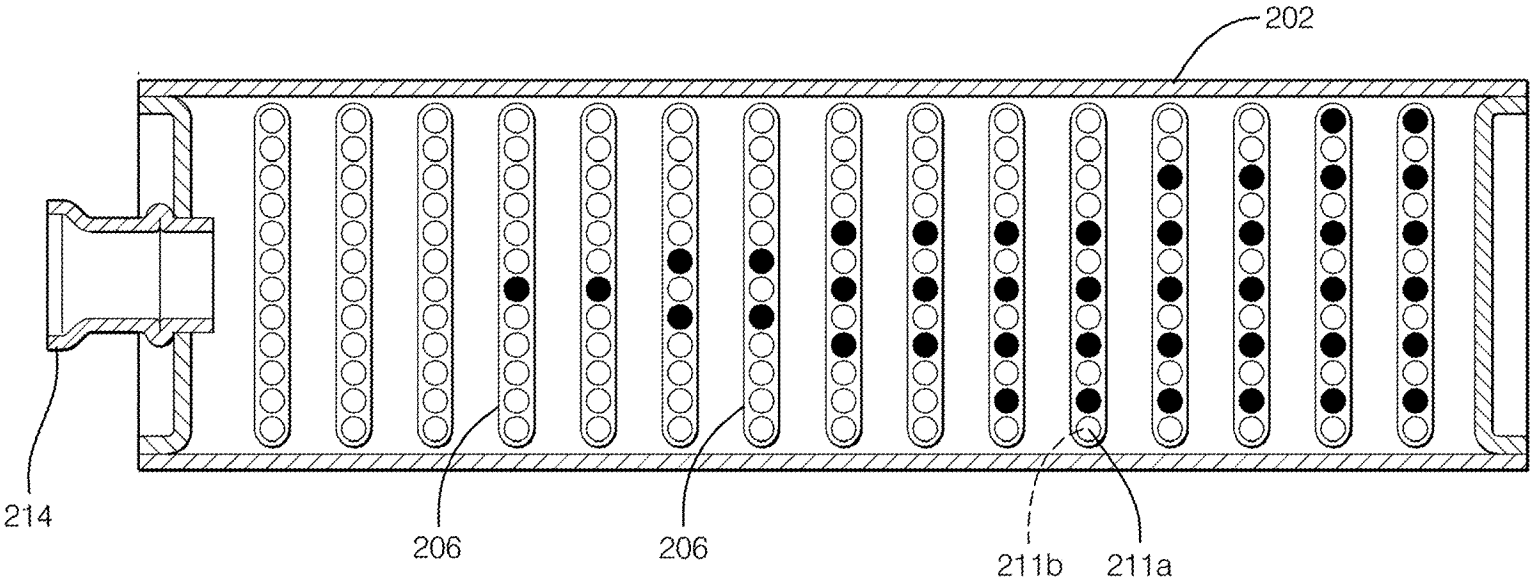
FIG. 4 shows an end view of the flat micro-channel tubes of the heat exchanger assembly of FIG. 3, through section line 4-4, having selective tube port closures.

Referring to FIGS. 3 and 4, in evaporator mode, it was found that by closing or obstructing selected tube ports 211*a*, the mass flow rate of refrigerant to the portion of the refrigerant tubes farthest from the refrigerant inlet 214 may be restricted to provide a substantially uniform distribution of refrigerant flow through the whole row of refrigerant tubes 206 to achieve uniform heat transfer through the core 212 of the heat exchanger assembly 200 as represented by heavy dash line (DL2). By closing selected tube ports 211*a* to achieve uniform flow of refrigerant through the core 212, the need for a collector in the upper manifold 202 may be eliminated, and possibly, the need of a distributor tube in the lower manifold 204 may be eliminated as well. It was also found that in condenser mode, the closure of the selected tube ports 211*a* has no sustentative adverse effect on the performance of the heat exchanger assembly 200. The tube ports 211*a*, 211*b* may be closed on either ends 207*a*, 207*b*.

Shown in FIG. 3 is a perspective view of an embodiment of a heat exchanger assembly 200 of the current invention. By closing selected tube ports 211*a* in certain refrigerant tubes 206 farthest away from the refrigerant inlet 214 of the inlet manifold 202, in evaporator mode, the refrigerant takes the path of least resistant by flowing through the open tube ports 211*a*, 211*b* of the refrigerant tubes 206 nearest the refrigerant inlet 214. Shown in FIG. 4 is a section view of the upper manifold 202 through section line 3-3. Extending into the upper manifold 202 is a plurality of substantially parallel flat micro-channel refrigerant tubes 206. Viewing directly into the tube ports 211*a* of the refrigerant tubes 206, the closed tube ports 211*a* are represented by a solid circle and open tube ports 211*a* are represented by white circles. In evaporator mode, with respect to the refrigerant inlet 214 of the inlet manifold 202, a portion of refrigerant tubes 206 farthest apart from the refrigerant inlet 214 have the greater number of tube ports 211*a* closed.

The precise locations and number of tube port 211*a* closures can be determined based on the desired restriction of refrigerant flow in that portion of the core 212 of the heat exchanger assembly 200 to achieve uniform flow of refrigerant through the core 212 of the heat exchanger assembly 200. For example, if a greater portion of refrigerant flow is desired through the row of tubes 206 nearest the refrigerant inlet 214, then a great number of refrigerant tubes 206 farthest from the refrigerant inlet 214 will be required to have its tube ports 211*a* closed or obstructed. In other words, if the momentum effect of refrigerant flowing to the end of the inlet header 204 is to be mitigated in order to achieve uniform refrigerant flow through the core 212 of the heat exchanger 200, then the tube ports 211*a* in the refrigerant tubes 206 within that portion of the core 212 farthest form the refrigerant inlet 214 are closed. The closure of the tube ports 211*a* raises the refrigerant pressure drop in the selected sections of the core 112, thus forcing the refrigerant to other sections of the core 212 that would normally be starved of refrigerant due to fluid momentum and distribution geometry.

The advantages of selectively closing tube ports 211*a* includes the reduction in the cost of manufacturing by eliminating at least the collector and the labor for the installation of the collector This would allow for greater flexibility in the heat exchanger assembly 200 design because a different size or shape collector is not required for each collection configuration required. Also, by closing off certain tube ports 211*a*, the refrigerant velocity in the remaining open ports will increase, and depending upon the flow velocity, will increase heat transfer in the open ports 211*a*; thereby, maintaining the same overall heat transfer for a given heat exchanger.

The manifolds 202, 204, refrigerant tubes 206, and fins 208 may be formed of a heat conductive material amendable to brazing, preferably an aluminum alloy. The refrigerant tubes 206 may be extruded from an aluminum alloy or formed by the folding of a sheet of aluminum alloy. The refrigerant tubes 206 and fins 208, forming the core 212, are assembled onto a stacker and the manifolds 202 are then assembled onto the core 212 forming the heat exchanger assembly 200. The assembly is then brazed into an integral heat exchanger assembly 200. While an upper manifold 202 and a lower manifold 204 is shown, it is not intended to be so limiting as to one being higher or lower than the other with respect to the direction of gravity. Those of ordinary skill in the art would recognize that the manifolds 202 may be positioned on the same horizontal plane utilizing a return tank or bending the refrigerant tubes 206 into U-flow tubes.

Prior to assembly of the core 212, the closure of the tube ports 211*a* may be accomplished by pinching the tube ports shut so long as the pinching does not extend into or below the tube to the header joint. The tube ports 211*a* may also be closed by inserting a sliver of aluminum alloy or other materials amendable to brazing into the designated tube ports 211*a* and brazing the tube ports 211*a* closed during the braze process. The tube ports 211*a* may be partially plugged rather than completely plugged, which can be accomplished by inserting a pin of reduced diameter into the selected ports and then squeezing the port from the outside to size it and then removing the pin. This plugging operation can take place in the stacker after the core 112 is assembled but before the manifolds 102 are installed, to reduce the process complexity.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having described the invention, it is claimed:

1. A heat exchanger as (200) comprising:

a first manifold (202);

a second manifold (204); and a plurality of refrigerant tubes (206) in hydraulic communication with the first manifold (202) and with one another via the first manifold (202);

wherein each tube of the plurality of refrigerant tubes (206) includes a plurality of micro-channels (210) having corresponding tube ports (211*a*) configured for refrigerant flow from the first manifold into the micro-channels and out of the micro-channels (210) into the second manifold; and wherein the plurality of refrigerant tubes includes at least a first group of refrigerant tubes and a second group of refrigerant tubes, wherein at least one and fewer than all of the tube ports (211 *a*) of each of the refrigerant tubes of the first group are obstructed, thereby restricting refrigerant flow through the tubes of the first group refrigerant tubes (206), and wherein each of the refrigerant tubes of the first group includes a greater number of the tube ports that are obstructed than each of the refrigerant tubes of the second group.

2. The heat exchanger assembly (200) of claim 1, wherein the second manifold (204) is spaced from the first manifold (202), and wherein the second manifold (204) is in hydraulic communication with the plurality of refrigerant tubes (206).

3. The heat exchanger assembly (200) of claim 2, wherein the second manifold (204) includes a first end, a second end opposite from the first end, and a refrigerant inlet adjacent the first end, wherein the first group of refrigerant tubes (206) is positioned adjacent to the second end.

4. The heat exchanger assembly (200) of claim 2, wherein the second manifold (204) includes a first end, a second end opposite the first end, and a refrigerant inlet adjacent the first end, and wherein the first group of refrigerant tubes (206) is adjacent the second end and the second group of refrigerant tubes (206) is positioned between the first group and the first end.

5. The heat exchanger assembly (200) of claim 4, wherein a path of lesser restriction for refrigerant flow extends through each of the refrigerant tubes of the second group of refrigerant tubes (206) than through each of the refrigerant tubes of the first group of refrigerant tubes (206).

6. The heat exchanger assembly (200) of claim 5, wherein the first manifold (202) and the second manifold are substantially parallel; and wherein the plurality of the refrigerant tubes (206) is disposed in parallel between the first manifold (202) and the second manifold.

7. The heat exchanger assembly (200) of claim 5, wherein at least one of the obstructed tube ports (211*a*) includes an inserted sliver of braze amendable material.

8. The heat exchanger assembly (200) of claim 5, wherein at least one of the obstructed tube ports (211*a*) is pinched closed.

9. A heat exchanger assembly (200) comprising:

a first manifold (202);

a second manifold (204) spaced from the first manifold (202); and a plurality of refrigerant tubes (206) in hydraulic communication with the first manifold (202) and the second manifold (204) and with one another both via the first manifold and via the second manifold, wherein each of the refrigerant tubes of the plurality of refrigerant tubes (206) includes a first plurality of tube ports (211 *a*) in the first manifold and a second plurality of tube ports in the second manifold; wherein the second manifold (204) includes a first end, a second end opposite from the first end, and a refrigerant inlet adjacent the first end, wherein the plurality of refrigerant tubes includes a first group of refrigerant tubes and a second group of refrigerant tubes, and wherein some and fewer than all of the tube ports (211*a*) of the first plurality of tube ports or of the second plurality of tube ports of each refrigerant tube of the first group are selectively obstructed, and wherein each of the refrigerant tubes of the first group includes a greater number of the tube ports that are obstructed than each of the refrigerant tubes of the second group, such that a refrigerant entering into the second manifold (204) through the refrigerant inlet flows substantially uniformly across the plurality of refrigerant tubes (206) from the second manifold (204) to the first manifold (202).

10. The heat exchanger assembly (200) of claim 9, wherein at least one of the obstructed tube ports (211*a*) is formed by inserting a pin of reduced diameter into a selected tube port and then squeezing the selected tube port from the outside to size it and then removing the pin.

11. The heat exchanger assembly (200) of claim 9, wherein at least one of the obstructed tube ports (211*a*) includes an inserted sliver of braze amendable material.

12. The heat exchanger assembly (200) of claim 9, wherein at least one of the obstructed tube ports (211*a*) is pinched closed.

13. The heat exchanger assembly (200) of claim 9, wherein at least one of the obstructed tube ports (211*a*) is formed by inserting a pin of reduced diameter into the selected ports and then squeezing the port from the outside to size it and then removing the pin.

* * * * *